US005085320A

United States Patent [19]

Scott

[11] Patent Number: 5,085,320

[45] Date of Patent: Feb. 4, 1992

[54] BAG FOR CARRYING A GAME BALL

[75] Inventor: Gregory D. Scott, Wasilla, Ak.

[73] Assignee: SGS International, Sandy, Utah

[21] Appl. No.: 530,598

[22] Filed: May 30, 1990

[51] Int. Cl.[5] ..... B65D 30/10; B65D 33/06

[52] U.S. Cl. ..... 206/315.9; 150/107

[58] Field of Search ..... 150/107; 190/115; 206/315.1, 315.9

[56] References Cited

U.S. PATENT DOCUMENTS

| | | | |
|---|---|---|---|
| D. 41,926 | 11/1911 | Hubbell . | |
| D. 125,988 | 3/1941 | Anderson | 206/315.9 |
| D. 149,869 | 6/1948 | Haney | 206/315.9 |
| D. 235,693 | 7/1975 | Tibbs | D87/C |
| D. 275,717 | 10/1984 | Carr | D3/36 |
| 1,513,463 | 10/1924 | Kidder . | |
| 1,650,223 | 11/1927 | Martinez | 206/315.9 |
| 1,717,587 | 6/1929 | Shipley | 206/315.9 |
| 1,751,275 | 3/1930 | Gammeter | 206/315.9 |
| 1,921,015 | 8/1933 | Young | 206/315.9 |
| 1,927,492 | 9/1933 | Halpin . | |
| 2,302,802 | 11/1942 | Roberts | 206/315.9 |
| 2,850,063 | 9/1958 | Horwitz . | |
| 4,494,650 | 1/1985 | Cullen | 206/315.9 |
| 4,510,982 | 4/1985 | Sangroni . | |
| 4,659,079 | 4/1987 | Blanchard | 206/315.9 |
| 4,691,824 | 9/1987 | Schindler | 206/315.9 |
| 4,795,031 | 1/1989 | Voss et al. | 206/315.9 |
| 4,877,166 | 10/1989 | Gelinas, Jr. | 206/315.9 |

FOREIGN PATENT DOCUMENTS

| | | | |
|---|---|---|---|
| 2326594 | 12/1974 | Fed. Rep. of Germany | 206/315.9 |

*Primary Examiner*—Jimmy G. Foster

*Attorney, Agent, or Firm*—Berne S. Broadbent

[57] ABSTRACT

A bag for carrying a game ball, such as, for example, a basketball. When configured to carry a basketball, the bag comprises two, substantially hemispherical members. A portion of one hemispherical member is preferably non-releasably attached to a portion of the other hemispherical member, and each hemispherical member is formed of a flexible material. The hemispherical members are also preferably provided with reinforcing ribbing. A zipper is provided for releasably fastening the two hemispherical members together so as to form a hollow, substantially spherical bag. The two hemispherical members are configured such that, when releasably fastened together, the hollow bag formed thereby is substantially the same size as a basketball. A handle is also secured adjacent said portions of the two hemispherical members which are non-releasably attached to each other for use both in placing a basketball inside the bag and in thereafter carrying the bag.

4 Claims, 2 Drawing Sheets

BAG FOR CARRYING A GAME BALL

BACKGROUND

1. The Field of the Invention

This invention relates to carrying bags and, more particularly, to a novel bag for carrying a game ball, such as, for example, a basketball.

2. The Background Art

Carrying a game ball to or from a playing area can be quite awkward and cumbersome. There appears to be no easy way, for example, to carry a football or basketball. As a result, even with a free hand, it is not uncommon for one to drop the game ball at least once in transit.

Besides the obvious inconvenience associated with dropping a game ball, dropping a game ball may soil the surface of the ball. The game ball may also become scarred by coming into contact with rough surfaces, such as cement or asphalt. Such soiling or damaging of the game ball may, of course, shorten the life of the game ball and may even, in some cases, render the ball unsuitable for further use on an actual playing surface.

For these and other reasons, various bags and carrying cases have been devised for transporting a game ball. Unfortunately, however, such prior art bags and cases are generally quite bulky to carry and store. Prior art game ball bags may also be fairly heavy, and some of the prior art bags and cases are extremely cumbersome and/or complicated to use.

BRIEF SUMMARY AND OBJECTS OF THE INVENTION

In view of the foregoing, it is a primary object of the present invention to provide a lightweight bag for carrying a game ball.

In addition, it is an object of the present invention to provide a bag for carrying a game ball which is both simple to use and easy to carry.

It is also an object of the present invention to provide a bag for carrying a game ball which is readily collapsible for storage.

Further, it is an object of the present invention to provide a bag for carrying a game ball which is inexpensive to manufacture, yet sufficiently durable to protect the game ball from damage.

Consistent with the foregoing objects, and in accordance with the invention as embodied and broadly described herein, a bag for carrying a game ball is disclosed in one embodiment of the present invention as including two, substantially symmetrical, cup-shaped members. Each said cup-shaped member is formed of a flexible material, and means are provided for releasably fastening the two cup-shaped members together so as to form a hollow bag. Significantly, the two cup-shaped members are configured such that, when releasably fastened together, the hollow bag formed thereby is substantially the same size and shape as the game ball to be carried.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENT

Figure 2:
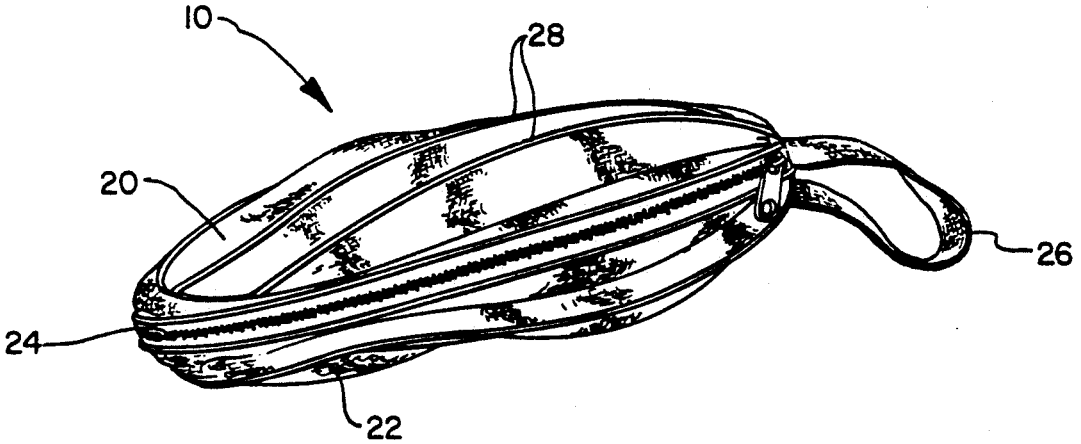
FIG. 2 is a perspective view illustrating the embodiment of FIG. 1 in empty, collapsed condition ready for storage.
Figure 3:
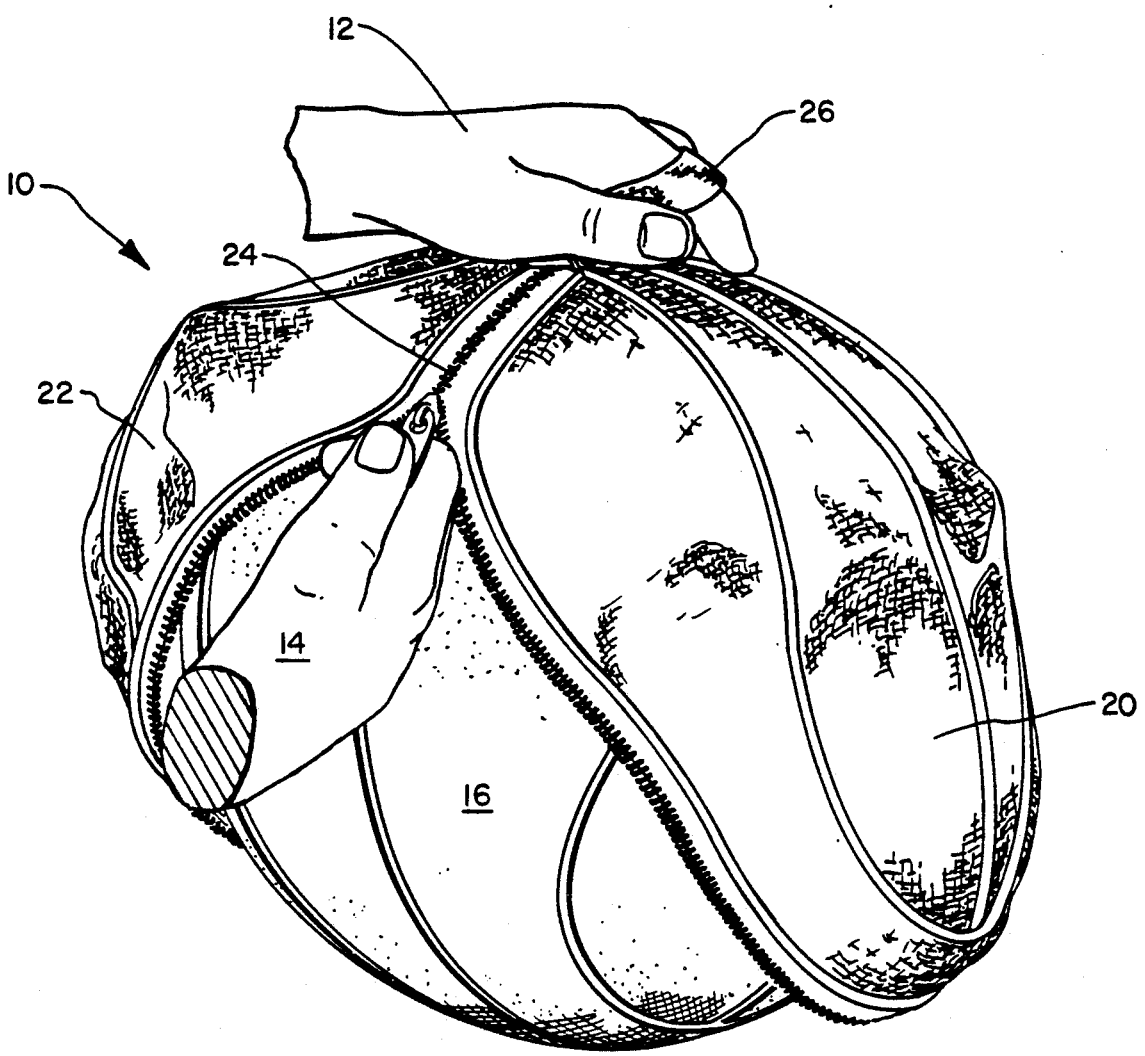
FIG. 3 is a perspective view of the embodiment of FIG. 1 illustrating the placement of a basketball therein.

It will be readily understood that the components of the present invention, as generally described and illustrated in the Figures herein, could be arranged and designed in a wide variety of different configurations. Thus, the following more detailed description of one embodiment of the present invention, as represented in FIGS. 1 through 3, is not intended to limit the scope of the invention, as claimed, but it is merely representative of one presently preferred embodiment of the invention.

The presently preferred embodiment of the invention will be best understood by reference to the drawings, wherein like parts are designated by like numerals throughout.

Figure 1:
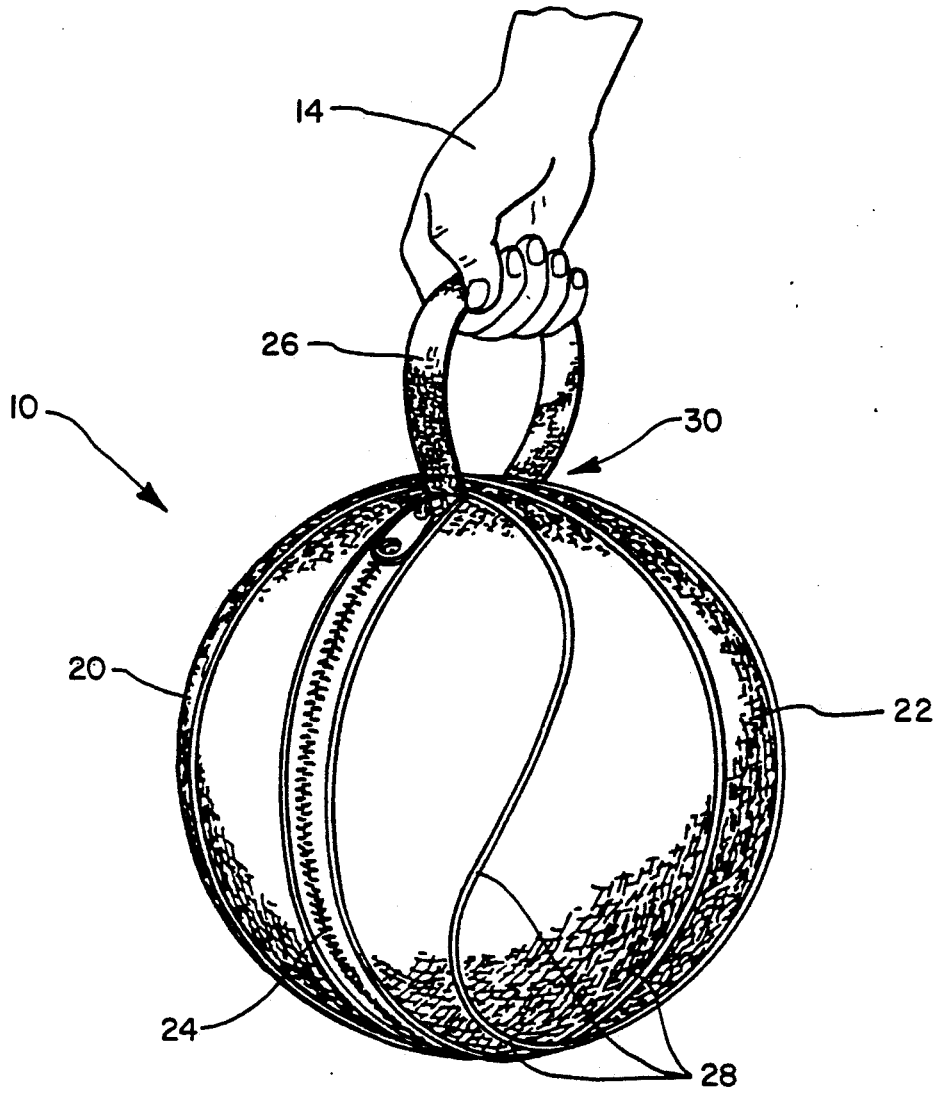
FIG. 1 is a perspective view showing one presently preferred embodiment of the carrying bag of the present invention.

One presently preferred embodiment of the game ball carrying bag of the present invention, designated generally at 10, is shown in its entirety in FIG. 1. The embodiment of bag 10 illustrated in FIG. 1 is intended to carry a basketball, and FIG. 1 shows bag 10 as it would appear with a basketball placed therein.

As shown in FIG. 1, bag 10 comprises two, substantially symmetrical, cup-shaped members 20 and 22. Significantly, members 20 and 22 can be connected together to form a hollow bag which is substantially the same size and shape as the game ball to be carried. As mentioned above, the embodiment of bag 10 illustrated in FIG. 1 is intended to carry a basketball, and members 20 and 22 are, accordingly, illustrated herein as being substantially hemispherical in shape.

A fastening means 24 is provided for selectively connecting members 20 and 22 together. As illustrated herein, fastening means 24 may, for example, comprise a zipper. Virtually any other suitable fastening means could, alternatively, be used, including, without limitation, buckles, snaps, and/or hook-and-loop fasteners.

In order to facilitate the handling of bag 10, a portion of member 20 may be sewn to, or otherwise securely and non-releasably attached to a corresponding portion of member 22. Thus, as depicted in FIG. 1, portions of members 20 and 22 indicated at 30 may be sewn together, while zipper 24 is used to otherwise secure member 20 to member 22.

Bag 10 is preferably provided with some type of handle 26 to facilitate the gripping of bag 10 by a hand 14. Handle 26 may be formed of any suitable material and may have any of a wide variety of suitable shapes and configurations. For example, as shown herein, handle 26 may comprise a loop of flexible material which is sewn or otherwise secured to bag 10.

It will be readily appreciated that handle 26 could be attached at virtually any location to bag 10. To facilitate the use of bag 10, however, it is presently preferred that handle 26 be attached to bag 10 adjacent the region 30 at which members 20 and 22 are non-releasably attached. Thus, as illustrated in FIG. 1, handle 26 is attached to bag 10 so as to extend across region 30.

Optionally, bag 10 may be provided with reinforcing ribbing 28 to increase the structural strength of bag 10. In addition, ribbing 28 may serve a decorative function. For example, as mentioned above, the embodiment of bag 10 illustrated herein is designed to carry a basketball. Therefore, ribbing 28 is positioned on bag 10 herein so as to imitate the appearance of a conventional basketball. Ribbing 28 could, of course, similarly be used to imitate the appearance of other types of game balls.

Bag 10 is preferably formed of a flexible, yet durable material. For example, bag 10 may be formed of nylon. Bag 10 could, alternatively, be formed of vinyl, synthetic leather or some other suitable fabric or material.

Due to the construction of bag 10 and the symmetry of each member 20 and 22, bag 10 will readily collapse when a game ball is not positioned therein. Bag 10 thus assumes an elongated, sock-like configuration, as illustrated in FIG. 2, thereby facilitating storage and minimizing needed storage space for bag 10 when not in use.

The placement of a game ball inside of bag 10 is illustrated in FIG. 3. As shown, members 20 and 22 of bag 10 are placed on opposite sides of game ball 16 while gripping handle 26 of bag 10 with one's hand 12. One's other hand 14 can then be used to close zipper 24 and thereby enclose game ball 16 within bag 10, as depicted in FIG. 1.

From the above discussion, it will be appreciated that the present invention provides a lightweight bag for carrying a game ball. The construction of the bag renders it both simple to use and easy to carry. Moreover, the two-part construction of the bag renders the bag readily collapsible for ease of storage. Also, while the bag is inexpensive to manufacture, it can be manufactured of durable materials sufficient to protect a game ball from damage during transport.

While the foregoing description of the bag of the present invention describes a bag for use in carrying a basketball, it will be readily appreciated that the present invention could be constructed so as to carry other types of game balls. For example, the bag of the present invention could be configured so as to carry a football, volleyball, or soccer ball.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A bag for carrying a game ball, the bag comprising:
two, substantially symmetrical, cup-shaped members, a portion of one cup-shaped member being non-releasably attached to a portion of the other cup-shaped member, and each said cup-shaped member being formed of a flexible material;
means for releasably fastening the two cup-shaped members together so as to form a hollow bag;
wherein the two cup-shaped members are configured such that, when releasably fastened together, the said hollow bag formed thereby is substantially the same size and shape as said game ball; and
a handle secured adjacent said portions of the two cup-shaped members which are non-releasably attached to each other.

2. A bag for carrying a game ball as defined in claim 1 wherein the means for releasably fastening the two cup-shaped members together comprises a zipper.

3. A bag for carrying a game ball as defined in claim 2 wherein each cup-shaped member is provided with reinforcing ribbing.

4. A bag for carrying a basketball, the bag comprising:
two, substantially hemispherical members, a portion of one hemispherical member being non-releasably attached to a portion of the other hemispherical member, each said hemispherical member being formed of a flexible material, and each hemispherical member being provided with reinforcing ribbing;
a zipper for releasably fastening the two hemispherical members together so as to form a hollow, substantially spherical bag;
wherein the two hemispherical members are configured such that, when releasably fastened together, the said hollow bag formed thereby is substantially the same size as said basketball; and
a handle secured adjacent said portions of the two hemispherical members which are non-releasably attached to each other.

* * * * *